US008337146B2

(12) United States Patent
Yu

(10) Patent No.: US 8,337,146 B2
(45) Date of Patent: Dec. 25, 2012

(54) ROTOR CASING TREATMENT WITH RECESSED BAFFLES

(75) Inventor: Hong Yu, Oakville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1025 days.

(21) Appl. No.: 12/477,464

(22) Filed: Jun. 3, 2009

(65) Prior Publication Data

US 2010/0310353 A1 Dec. 9, 2010

(51) Int. Cl.
*F04D 29/66* (2006.01)

(52) U.S. Cl. ..... 415/119; 415/173.1; 415/173.4

(58) Field of Classification Search ..... 415/57.3, 415/57.4, 58.6, 119, 173.1, 173.4
See application file for complete search history.

(56) References Cited

U.S. PATENT DOCUMENTS

| | | | |
|---|---|---|---|
| 4,239,452 | A | 12/1980 | Roberts, Jr. |
| 4,466,772 | A | 8/1984 | Okapuu et al. |
| 5,282,718 | A | 2/1994 | Koff et al. |
| 5,308,225 | A | 5/1994 | Koff et al. |
| 5,607,284 | A | 3/1997 | Byrne et al. |
| 6,164,911 | A | 12/2000 | LeBlanc et al. |
| 6,231,301 | B1 | 5/2001 | Barnett et al. |
| 6,435,819 | B2 | 8/2002 | Irie et al. |
| 6,499,940 | B2 | 12/2002 | Adams |
| 6,582,189 | B2 | 6/2003 | Irie et al. |
| 6,585,479 | B2 | 7/2003 | Torrance |
| 6,742,983 | B2 | 6/2004 | Schmuecker |
| 6,832,890 | B2 | 12/2004 | Booth |
| 6,935,833 | B2 | 8/2005 | Seitz |
| 7,186,072 | B2 | 3/2007 | Seitz |
| 7,210,905 | B2 | 5/2007 | Lapworth |
| 2008/0044273 | A1 | 2/2008 | Khalid |

*Primary Examiner* — Dwayne J White

(74) *Attorney, Agent, or Firm* — Norton Rose Canada LLP

(57) ABSTRACT

A compressor rotor casing treatment comprises a plurality of axially spaced-apart circumferential grooves defined in the inner surface of the compressor casing adjacent the tips of the compressor rotor blades. A plurality of circumferentially spaced-apart recessed baffles projects from a bottom surface of each groove to a distance less than a full height of the groove.

19 Claims, 4 Drawing Sheets

ROTOR CASING TREATMENT WITH RECESSED BAFFLES

TECHNICAL FIELD

The application relates generally to gas turbine engines and, more particularly, to a rotor casing treatment for increasing stall margin with large rotor tip clearance.

BACKGROUND OF THE ART

Casing treatments are known to improve stall margin on gas turbine fans and compressors. For instance, it is known to define circumferential slots in the inner surface of compressor casings adjacent the tip of a row of compressor blades. One problem associated with such casing surface treatment is that the slot bottoms or endwalls tend to burn in use. The flat endwall configuration of the slots creates flow stagnation areas which result in the formation of hot spots on the rotor casing.

Furthermore, under certain operating conditions, e.g. bird strikes, icing or hail storm, the rotor tip clearance can be much larger than the nominal tip clearance. The maximum tip clearance can be as much as four or five times of the normal running clearance. Maintaining adequate stall margin with such large tip clearances is challenging from an aerodynamic design point of view. Conventional rotor casing treatments are designed for nominal tip clearance and, thus, not adapted to effectively extend stall margin when the tip clearance is greater than the nominal value.

Accordingly, there is a need to provide an improved rotor casing treatment which addresses the above mentioned issues.

SUMMARY

In one aspect, there is provided a compressor for a gas turbine engine, comprising a shroud surrounding a rotor having a plurality of radially extending blades mounted for rotation about a central axis of the engine, each blade having leading and trailing edges and a tip, said shroud having an inner surface surrounding the tip of the blades, a plurality of axially spaced-apart circumferential grooves defined in said inner surface of the shroud adjacent said tips, at least some of the grooves being disposed axially between the leading and trailing edges of the blades, and a plurality of circumferentially spaced-apart recessed baffles projecting from a bottom surface of each groove to a distance less than a full height of the groove.

In a second aspect, there is provided a compressor for a gas turbine engine, comprising a shroud surrounding a rotor having a plurality of radially extending blades mounted for rotation about a central axis of the engine, each blade having leading and trailing edges and a tip, said shroud having an inner surface surrounding the tip of the blades, and a plurality of axially spaced-apart circumferential grooves defined in said inner surface of the shroud adjacent said tips, each of said grooves having a wavy bottom surface including a succession of crests and troughs in a circumferential direction, said crests being provided in the form of baffles recessed in said grooves by a distance d1.

In a third aspect, there is provided a method for improving stall margin in a gas turbine engine compressor having a case surrounding a rotor including a plurality of blades mounted for rotation about a central axis, the method comprising defining a plurality of axially spaced-apart circumferential grooves in an inner surface of the case about the blades, and providing a circumferential array of recessed baffles in each of said grooves, the baffles being recessed in the grooves by a distance d1.

DESCRIPTION OF THE DRAWINGS

Reference is now made to the accompanying figures, in which.

DETAILED DESCRIPTION OF THE PREFERRED EMBODIMENTS

Figure 1:
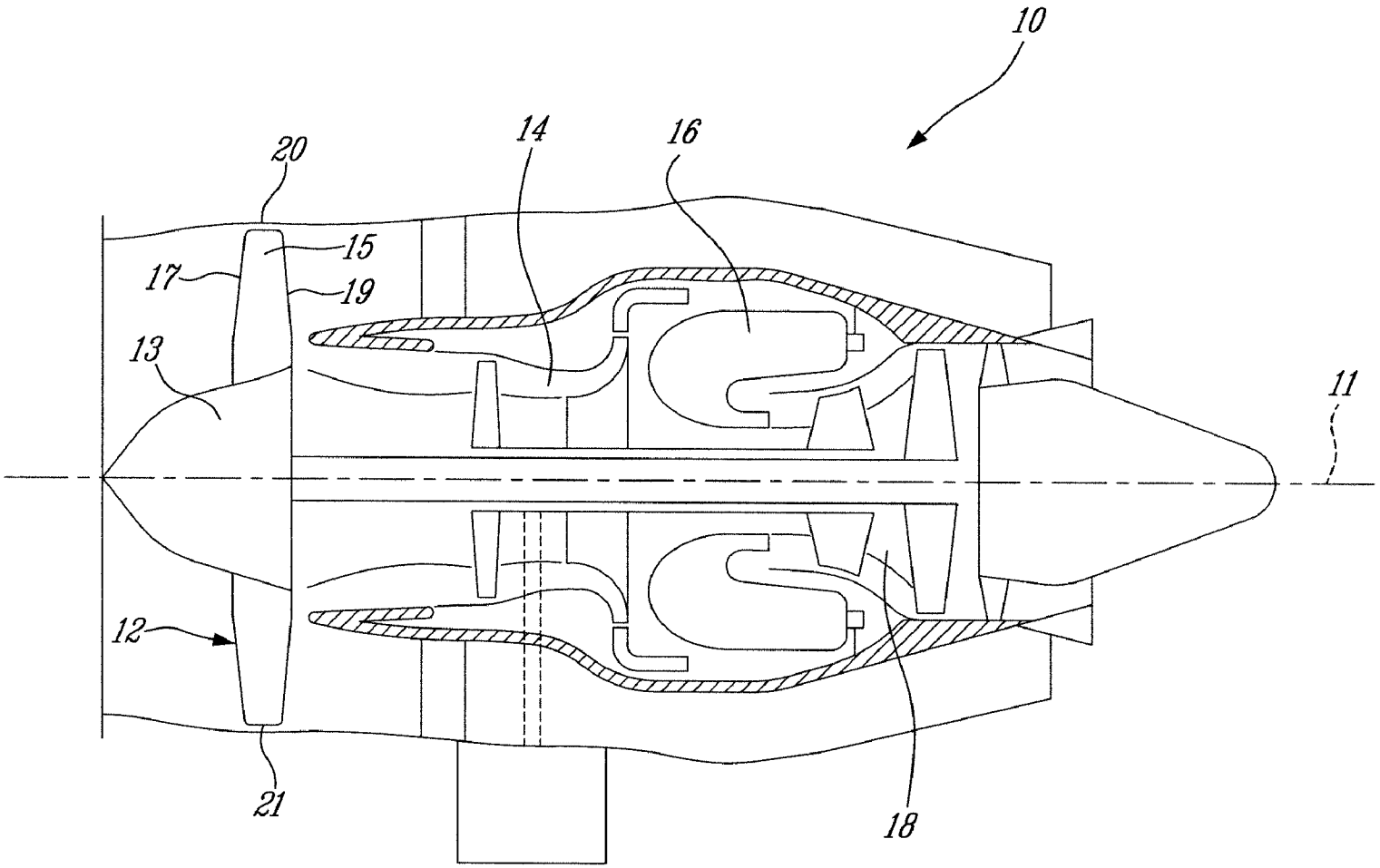
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a transonic fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 3:
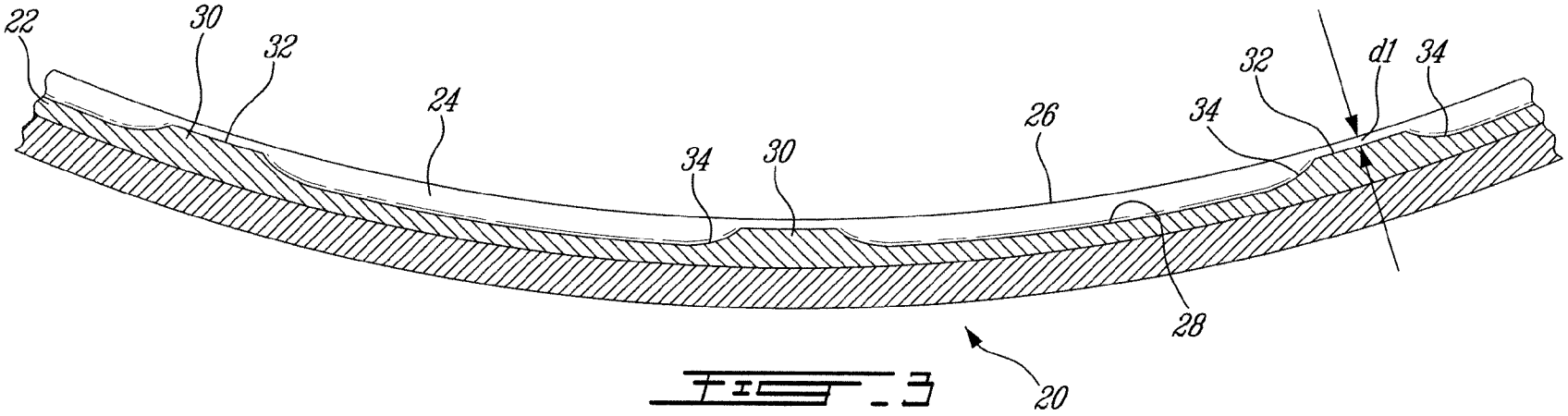
FIG. 3 is a cross-sectional view taken along line 3-3 in FIG. 2.
Figure 4:
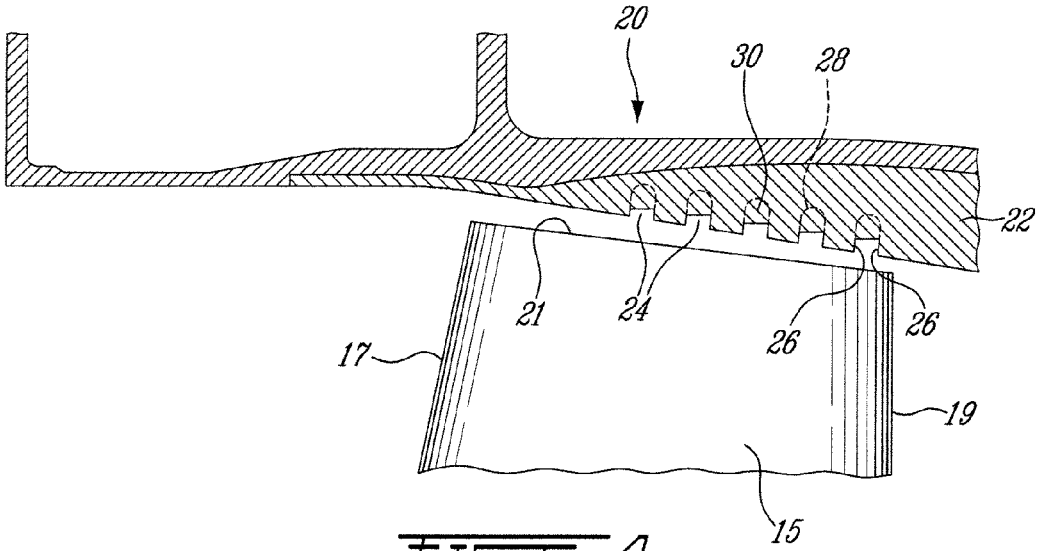
FIG. 4 is a cross-sectional view taken along line 4-4 in FIG. 2.
Figure 5:
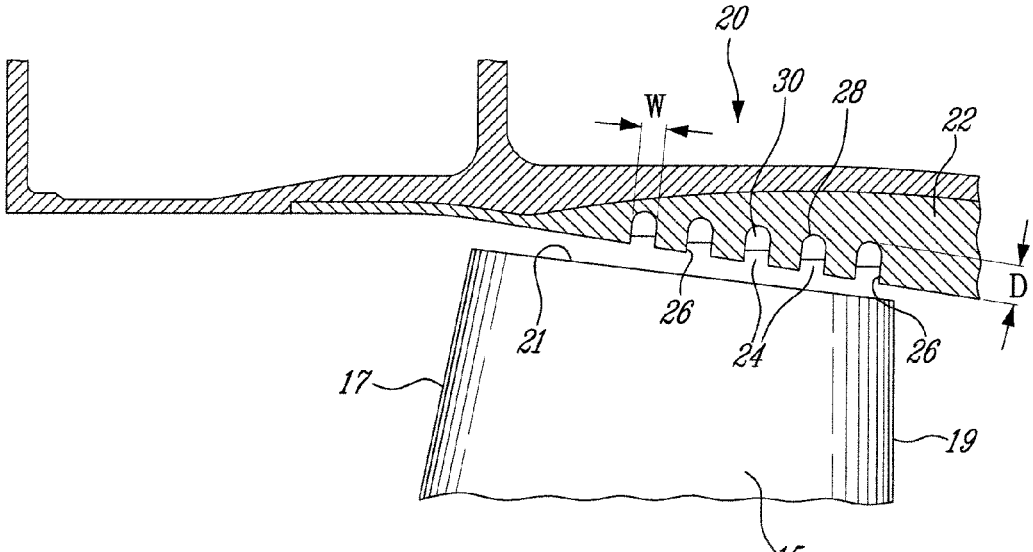
FIG. 5 is a cross-sectional view taken along line 5-5 in FIG. 2.

The fan 12, also referred to as a low compressor, comprises a rotor 13 mounted for rotation about the engine central axis 11. The rotor 13 is provided with a plurality of radially extending blades 15. Each blade 15 has a leading edge 17 and a trailing edge 19 extending radially outwardly from the rotor hub to a tip 21. The rotor 13 is surrounded by a casing 20 including a stationary annular shroud disposed adjacent the tips 21 of the blades 15 and defining an outer boundary for the main flow path. As shown in FIGS. 3 to 5, the casing inner surface may be lined with a layer of abradable material 22. The radial distance or gap between the tip 21 of the blades 15 and the adjacent inner surface of the casing 20 is defined as the rotor tip clearance. Each rotor is designed with a nominal rotor tip clearance. However, under certain operating conditions, the rotor tip clearance can become significantly larger than the nominal value.

Figure 2:
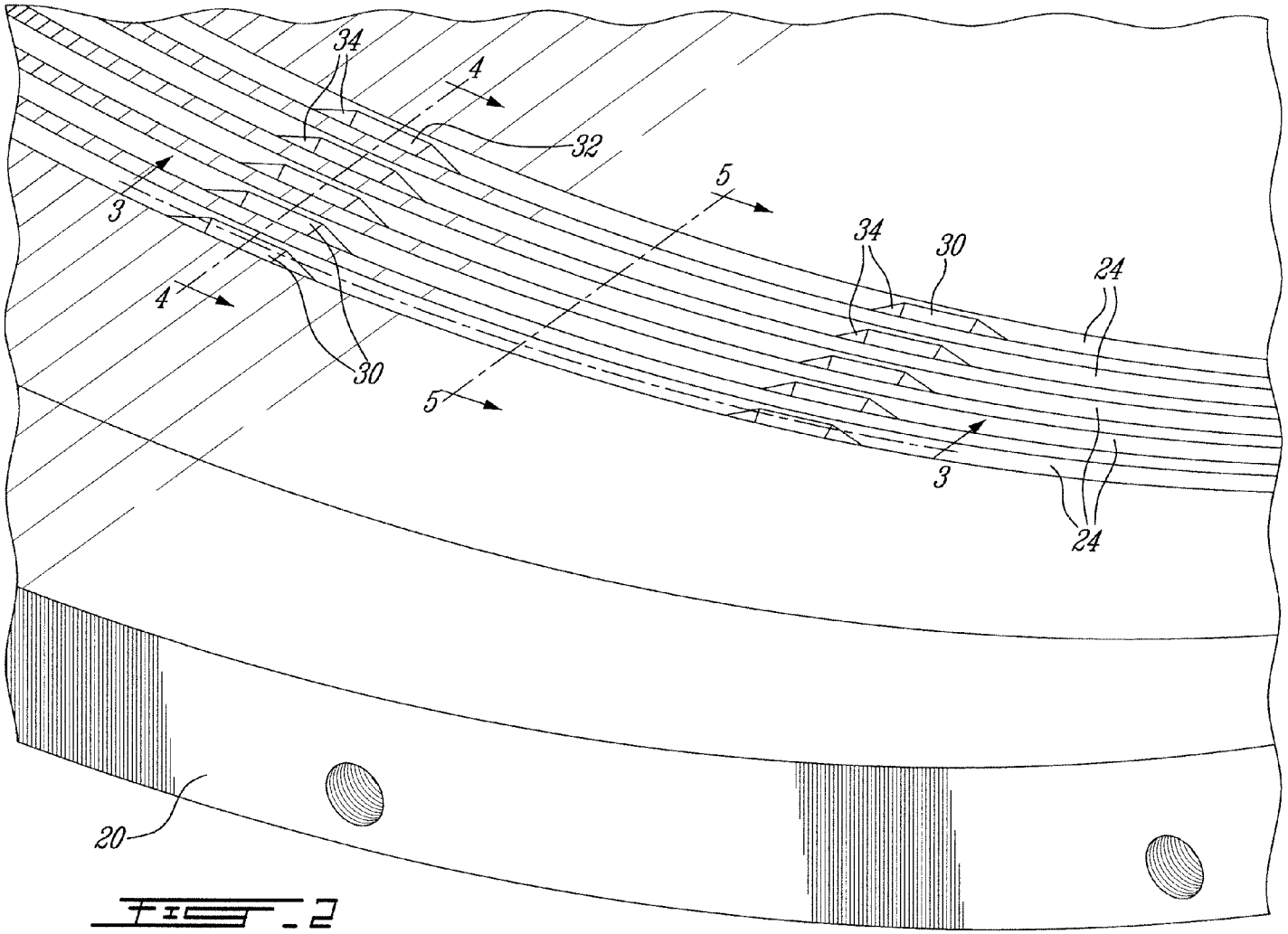
FIG. 2 is an enlarged cross-sectional view of the fan casing of the engine shown in FIG. 1.

Referring to FIG. 2, it can be seen that a surface treatment is applied to the low compressor or fan casing 20. As will be seen hereinafter, the surface treatment allows improving stall margin even when the rotor tip clearance is significantly greater than the original or nominal rotor tip clearance. The fan casing treatment comprises a series of regularly axially spaced-apart circumferential grooves 24 defined in the inner surface of the fan casing 20. The grooves 24 extend continuously around 360 degrees. In the illustrated example, five shallow circumferentially extending grooves 24 are embedded in the abradable layer 22 of the rotor shroud around the blades 15. However, it is understood that the series of grooves could be composed of more or less than five grooves. For instance, the surface treatment could comprise from 3 to 9 grooves depending on the rotor configuration.

As shown in FIGS. 4 and 5, the grooves 24 are axially located between the leading edge 17 and the trailing edge 19 of the blades 15. According to one example, the first or upstream groove 24 is located downstream of the blade leading edge 17 and spaced therefrom by a distance corresponding to approximately 40 to 50% of the chord length of the blades 15. The last or downstream groove 24 should be positioned upstream of the blade trailing edges 19.

Each groove 24 is defined by a pair of axially opposed substantially flat sidewalls 26 extending from a rounded or semi-circular bottom surface 28. As shown in FIG. 5, each groove 24 has a depth D and a width W. The depth D of the grooves 24 should be between 2 to 3 times of the maximum rotor tip clearance. The depth of the grooves 24 may vary from the first to the last. The width W of the grooves 24 should be between 1 to 2 times of the maximum rotor tip clearance.

Now referring concurrently to FIGS. 2 to 5, it can be seen that a plurality of regularly circumferentially spaced-apart baffles 30 are recessed in each of the grooves 24. As shown in FIG. 2, the arrays of baffles 30 in the grooves 24 can be angularly aligned with respect to each other. However, the baffles 30 could as well be angularly staggered in the different grooves 24. Also the number of baffles in the grooves 24 does not have to be the same. The number of baffles 30 in each groove 24 should be larger than the number of rotor blades 15 but less than 2 times of the latter. As shown in FIG. 3, the baffles 30 are recessed in the grooves 24 by a distance or depth d1 equal to the maximum trench of the casing during the worst rotor imbalance conditions (e.g. after a bird strike).

The baffles 30 can be provided in the form of bumps projecting from the bottom surface 28 of the grooves 24. The baffles do not necessarily have to be the same shape. The baffles 30 can be integrally machined, moulded or otherwise formed on the bottom 28 of the grooves 24. For instance, cutting tools, such as conventional wood ruff cutters, could be used for machining the grooves 24 and the recessed baffles 30 in the abradable layer 22. A smaller amount of material is simply removed from the abradable layer 22 at the locations where the recessed baffles 30 are to be defined. In this way, the baffles 30 can be formed in the grooves 24 in a cost effective manner. The reparability of the casing 20 is good since the grooves 24 and the baffles 30 are machined in abradable material.

The baffles 30 extend the full width W of the grooves 24 between the groove sidewalls 26 (see FIG. 4 or 5). As shown in FIGS. 2 and 3, each baffle 30 has a substantially flat top surface 32 with fillets 34 at opposed ends thereof smoothly merging with the bottom surface 28 of the groove 24 in the circumferential direction. As clearly show n in FIG. 3, the top surface 32 of the baffles 30 is recessed within the grooves 24 by a predetermined distance d1. The groove bottom surface 28 and the baffles 30 form a wavy radially inwardly facing surface along the full circumference of each groove 24. The bumps or baffles 30 on the bottom surface 28 of the grooves 24 contribute to prevent the formation of stagnation areas along the grooves 24. The groove wavy bottom surface causes unsteadiness in the fluid flow which eliminates stagnation places and, thus, the local hot spots which would otherwise result in burn spots on the fan case. The recessed baffle design relief local pressure and temperature rise near the baffles 30. Therefore, the durability of the fan casing 20 is improved.

The above described groove endwall contouring also improve stall margin even when the rotor tip clearance is up to four times of the nominal rotor clearance. Engine tests with fan casing configuration with large rotor tip clearance have shown that the fan is stall free up to the fan speed limit when using the above described fan casing contour recessed baffle design.

The above description is meant to be exemplary only, and one skilled in the art will recognize that changes may be made to the embodiments described without departing from the scope of the invention disclosed. While the rotor casing treatment has been described in connection with a fan casing, it is understood that the surface treatment could be applied to other type rotor casing. For instance, it could be applied in the high compressor section of the engine. The features of the above casing treatment are particularly suited for high load fans and compressor rotors requiring extra stall margin with a large tip clearance. Still other modifications which fall within the scope of the present invention will be apparent to those skilled in the art, in light of a review of this disclosure, and such modifications are intended to fall within the appended claims.

What is claimed is:

1. A compressor for a gas turbine engine, comprising a shroud surrounding a rotor having a plurality of radially extending blades mounted for rotation about a central axis of the engine, each blade having leading and trailing edges and a tip, said shroud having an inner surface surrounding the tip of the blades, a plurality of axially spaced-apart circumferential grooves defined in said inner surface of the shroud adjacent said tips, at least some of the grooves being disposed axially between the leading and trailing edges of the blades, and a plurality of circumferentially spaced-apart recessed baffles projecting from a bottom surface of each groove to a distance less than a full height of the groove, wherein each recessed baffle has a substantially flat top surface bounded in a circumferential direction by a pair of fillets merging with the bottom surface of the grooves.

2. The compressor defined in claim 1, wherein the grooves and the recessed baffles are integrally formed in a layer of abradable material provided on the inner surface of the shroud.

3. The compressor defined in claim 1, wherein said plurality of axially spaced-apart circumferential grooves comprises from 3 to 9 grooves, and wherein a first one of the grooves is axially spaced from the upstream edge of the blades by a distance of about 40% to about 50% of a chord length of the blades.

4. The compressor defined in claim 3, wherein a last one of the plurality of axially spaced-apart circumferential grooves is disposed upstream of the trailing edge of the blades relative to a flow direction of a working fluid through the compressor.

5. The compressor defined in claim 1, wherein the number of recessed baffles per groove is less than 2 times of the number of blades.

6. The compressor defined in claim 5, wherein the number of recessed baffles per groove is larger than the number of blades.

7. The compressor defined in claim 1, wherein the depth of the grooves is comprised between 2 to 3 times of a maximum rotor tip clearance defined between the tips of the blades and the inner surface of the shroud.

8. The compressor defined in claim 1, wherein each groove has a pair of axially facing sidewalls defining therebetween a width, the width of the grooves being comprised between 1 to 2 times of a maximum rotor tip clearance defined between the tips of the blades and the inner surface of the shroud.

9. The compressor defined in claim 1, wherein each groove has a width defined between a pair of axially facing sidewalls, the recessed baffles extending the full width of the groove.

10. The compressor defined in claim 1, wherein the recessed baffles are staggered from one groove to another.

11. The compressor defined in claim 1, wherein the recessed baffles in one groove are angularly aligned with the recessed baffles of another one of the grooves.

12. The compressor defined in claim 1, wherein the grooves have a different depth.

13. The compressor defined in claim 1, wherein the grooves have a different number of baffles recessed therein.

14. A compressor for a gas turbine engine, comprising a shroud surrounding a rotor having a plurality of radially extending blades mounted for rotation about a central axis of the engine, each blade having leading and trailing edges and a tip, said shroud having an inner surface surrounding the tip of the blades, and a plurality of axially spaced-apart circumferential grooves defined in said inner surface of the shroud adjacent said tips, each of said grooves having a wavy bottom surface including a succession of crests and troughs in a circumferential direction, said crests being provided in the form of baffles recessed in said grooves by a distance d1, and wherein the baffles have a substantially flat top surface bounded in a circumferential direction by a pair of fillets.

15. The compressor defined in claim 14, wherein said plurality of axially spaced-apart circumferential grooves comprises from 3 to 9 grooves, and wherein a first one of the grooves is axially spaced from the upstream edge of the blades by a distance of about 40% to about 50% of a chord length of the blades.

16. The compressor defined in claim 15, wherein the number of baffles per groove is less than 2 times of the number of blades but larger than the number of blades.

17. The compressor defined in claim 14, wherein the depth of the grooves is comprised between 2 to 3 times of a maximum rotor tip clearance defined between the tips of the blades and the inner surface of the shroud.

18. The compressor defined in claim 14, wherein each groove has a pair of axially facing sidewalls defining therebetween a width, the width of the grooves being comprised between 1 to 2 times of a maximum rotor tip clearance defined between the tips of the blades and the inner surface of the shroud.

19. A method for improving stall margin in a gas turbine engine compressor having a case surrounding a rotor including a plurality of blades mounted for rotation about a central axis, the method comprising defining a plurality of axially spaced-apart circumferential grooves in an inner surface of the case about the blades, and providing a circumferential array of recessed baffles in each of said grooves, the baffles being recessed in the grooves by a distance d1 and having a substantially flat top surface bounded by a pair of fillets merging with a bottom wall of the grooves.

* * * * *